US011959648B2

(12) United States Patent
Ishida et al.

(10) Patent No.: US 11,959,648 B2
(45) Date of Patent: Apr. 16, 2024

(54) HEAT EXCHANGER AND AIR CONDITIONING APPARATUS

(71) Applicant: Mitsubishi Electric Corporation, Tokyo (JP)

(72) Inventors: Hirotaka Ishida, Tokyo (JP); Hiroaki Makino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 392 days.

(21) Appl. No.: 17/426,409

(22) PCT Filed: Apr. 3, 2019

(86) PCT No.: PCT/JP2019/014769
§ 371 (c)(1),
(2) Date: Jul. 28, 2021

(87) PCT Pub. No.: WO2020/202492
PCT Pub. Date: Oct. 8, 2020

(65) Prior Publication Data
US 2022/0099312 A1 Mar. 31, 2022

(51) Int. Cl.
*F24F 1/18* (2011.01)
*F25B 39/00* (2006.01)
*F28F 1/40* (2006.01)

(52) U.S. Cl.
CPC ..... *F24F 1/18* (2013.01); *F28F 1/40* (2013.01); *F25B 39/00* (2013.01)

(58) Field of Classification Search
CPC ... F24F 1/18; F24F 1/0067; F28F 1/40; F25B 39/00; F25B 13/00; F25B 39/02; F25B 2500/01; F25B 2500/09; F25B 39/04
See application file for complete search history.

(56) References Cited

U.S. PATENT DOCUMENTS

2012/0145364 A1 6/2012 Oritani et al.
2015/0204599 A1* 7/2015 Chisaki ..... F24F 1/24 62/426
2021/0010704 A1* 1/2021 Kawashima ..... F24F 11/36

FOREIGN PATENT DOCUMENTS

CN 201935488 U 8/2011
JP S58-150799 A 9/1983
(Continued)

OTHER PUBLICATIONS

Office Action dated Jun. 20, 2023 issued in corresponding Chinese Patent Application No. 201980093134.3 (and English machine translation).

(Continued)

*Primary Examiner* — Nelson J Nieves
*Assistant Examiner* — Matthew John Moscola
(74) *Attorney, Agent, or Firm* — POSZ LAW GROUP, PLC

(57) ABSTRACT

A heat exchanger includes a plurality of fins and a plurality of tubes that are inserted into the fins and that allow refrigerant to flow in the tubes. The tubes include first heat transfer tubes and second heat transfer tubes. Each of the first heat transfer tubes includes grooves formed in an inner surface of the first heat transfer tube, and has an inside diameter Da and a groove depth Ta. Each of the second heat transfer tubes has an inner surface smoothed, has an inside diameter Db, and is connected to an associated one of the first heat transfer tubes. $Da-2\times Ta \leq Db$ is satisfied.

2 Claims, 4 Drawing Sheets

(56) References Cited

FOREIGN PATENT DOCUMENTS

| | | | |
|---|---|---|---|
| JP | S61-114092 | A | 5/1986 |
| JP | S63-104955 | U | 7/1988 |
| JP | H02/143094 | A | 6/1990 |
| JP | H10-176867 | A | 6/1998 |
| JP | H10-1602066 | A | 6/1998 |
| JP | 2001-124480 | A | 5/2001 |
| JP | 2001-330388 | A | 11/2001 |
| JP | 2004-333013 | A | 11/2004 |
| JP | 2009-063202 | A | 3/2009 |
| JP | 2011-117712 | A | 6/2011 |
| JP | 2014-040982 | A | 3/2014 |
| JP | 6040633 | B2 | 12/2016 |
| WO | 2001/031275 | A1 | 5/2001 |

OTHER PUBLICATIONS

Office Action dated Apr. 26, 2022 issued in corresponding JP Patent Application No. 2021-511849 (and English translation).
Office Action dated May 12, 2022 issued in corresponding DE Patent Application No. 112019007149.1 (and English translation).
Office Action dated Feb. 22, 2023 issued in corresponding DE Patent Application No. 112019007149.1 (and English translation).
Office Action dated Apr. 22, 2023 issued in corresponding CN Patent Application No. 201980093134.3 (and English machine translation).
Office Action dated Jan. 18, 2023 issued in corresponding CN Patent Application No. 201980093134.3 (and English machine translation).
International Search Report of the International Searching Authority dated Jun. 18, 2019 for the corresponding International application No. PCT/JP2019/014769 (and English translation).

* cited by examiner

HEAT EXCHANGER AND AIR CONDITIONING APPARATUS

CROSS REFERENCE TO RELATED APPLICATION

This application is a U.S. national stage application of PCT/JP2019/014769 filed on Apr. 3, 2019, the contents of which are incorporated herein by reference.

TECHNICAL FIELD

The present disclosure relates to a heat exchanger including fins and tube, and also to an air-conditioning apparatus.

BACKGROUND ART

In the past, a fin-and-tube heat exchanger including fins and tubes and an air-conditioning apparatus including the heat exchanger have been known. The fins are arranged and spaced from each other. The tubes are heat transfer tubes that extend through the fins in a direction perpendicular to the fins. The air-conditioning apparatus includes a refrigerant circuit in which a compressor, a flow switching device, a heat exchanger that operates as a condenser, an expansion unit, and a heat exchanger that operates as an evaporator are connected by pipes. When a heat exchanger provided in an indoor unit operates as a condenser, a heating operation is performed, and when the heat exchanger in the indoor unit operates as an evaporator, a cooling operation is performed. Patent Literature 1 discloses a heat exchanger that is provided for an air-conditioning apparatus, and that includes first heat transfer tubes through which two-phase gas-liquid refrigerant flows when the heat exchanger operates as a condenser during the heating operation, and second heat transfer tubes through which subcooled refrigerant flows when the heat exchanger operates as a condenser during the heating operation. In Patent Literature 1, the tube diameter of the first heat transfer tubes through which two-phase gas-liquid refrigerant flows is set larger than the tube diameter of the second heat transfer tubes through which subcooling refrigerant flows.

CITATION LIST

Patent Literature

Patent Literature 1: Japanese Unexamined Patent Application Publication No. 2004-333013

SUMMARY OF INVENTION

Technical Problem

However, when the heat exchanger for an air-conditioning apparatus disclosed in Patent Literature 1 operates as an evaporator during the cooling operation, refrigerant expanded by the expansion unit flows through the second heat transfer tubes, and then flows through the first heat transfer tubes. Since the second heat transfer tubes are thinner than the first heat transfer tubes, a smaller amount of refrigerant is filled into the second heat transfer tubes, however, a pressure loss of two-phase gas-liquid refrigerant that flows in the second heat transfer tubes is increased. As the pressure loss of the refrigerant that flows in the second heat transfer tubes is increased, the heat exchange efficiency of the heat exchanger for an air-conditioning apparatus is decreased.

The present disclosure is applied to solve the above problem, and relates to a heat exchanger and an air-conditioning apparatus that reduce lowering of the heat exchange efficiency.

Solution to Problem

A heat exchanger according to one embodiment of the present disclosure includes a plurality of fins and a plurality of tubes that are inserted into the fins and that allow refrigerant to flow in the tubes. The tubes include first heat transfer tubes and second heat transfer tubes. Each of the first heat transfer tubes includes grooves formed in an inner surface of the first heat transfer tube, and has an inside diameter Da and a groove depth Ta. Each of the second heat transfer tubes has an inner surface smoothed, has an inside diameter Db, and is connected to an associated one of the first heat transfer tubes. $Da-2\times Ta\leq Db$ is satisfied.

Advantageous Effects of Invention

According to the embodiment of the present disclosure, since $Da-2\times Ta\leq Db$ is satisfied, the inside diameter Db of the second heat transfer tube is set to the largest possible value. It is therefore possible to reduce an increase in pressure loss of refrigerant that flows through the second heat transfer tube. Thus, the heat exchanger can reduce lowering of the heat exchange efficiency.

DESCRIPTION OF EMBODIMENTS

A heat exchanger and an air-conditioning apparatus according to each of embodiments of the present disclosure will be described with reference to the drawings. It should be noted that the following descriptions concerning the embodiments are not limiting. In addition, relationships in size between the components as illustrated in the figures to be referred to which include FIG. 1 may differ from those between actual components. Also, in the following descriptions, terms related to directions are used as appropriate in order that the components be more easily understood, however, they are not limiting. The terms related to directions are, for example, "upper," "lower," "right," "left," "front," and "rear."

Embodiment 1

Figure 1:
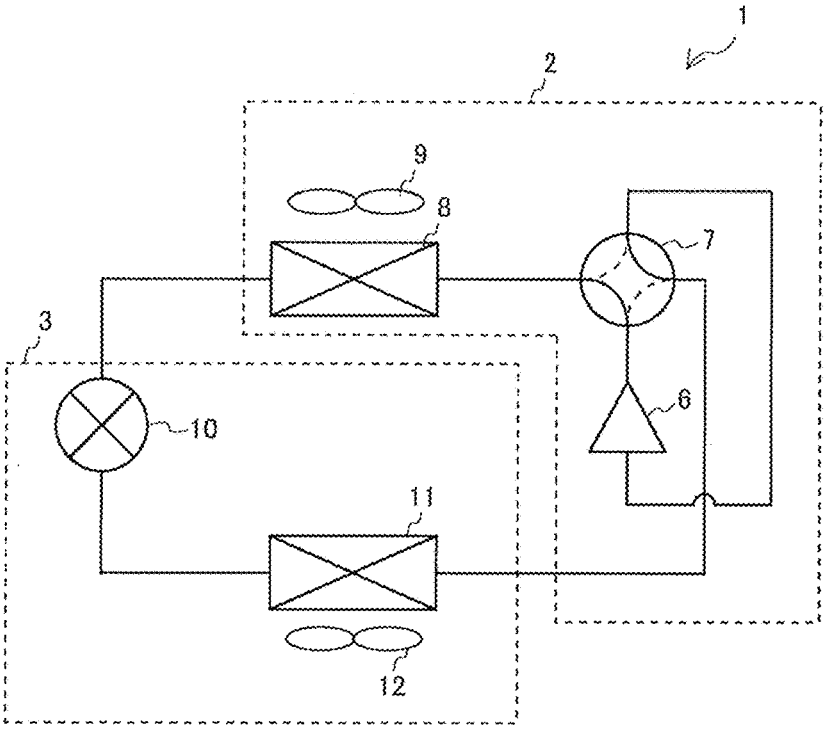
FIG. 1 is a circuit diagram illustrating an air-conditioning apparatus according to Embodiment 1.

FIG. 1 is a circuit diagram illustrating an air-conditioning apparatus 1 according to Embodiment 1. As illustrated in FIG. 1, the air-conditioning apparatus 1 is an apparatus that conditions air in a room, and includes an outdoor unit 2 and an indoor unit 3. The outdoor unit 2 includes, for example, a compressor 6, a flow switching device 7, an outdoor heat exchanger 8, an outdoor fan 9, and an expansion unit 10. The indoor unit 3 includes, for example, a heat exchanger 11 and an indoor fan 12.

The compressor 6, the flow switching device 7, the outdoor heat exchanger 8, the expansion unit 10, and the heat exchanger 11 are connected by refrigerant pipes 5 to form a refrigerant circuit 4. The compressor 6 sucks low-temperature and low-pressure refrigerant, compresses the sucked low-temperature and low-pressure refrigerant into high-temperature and high-pressure refrigerant, and discharges the compressed high-temperature and high-pressure refrigerant. The flow switching device 7 changes the flow direction of refrigerant in the refrigerant circuit 4, and is, for example, a four-way valve. The outdoor heat exchanger 8 causes heat exchange to be performed, for example, between outdoor air and refrigerant. The outdoor heat exchanger 8 operates as a condenser during the cooling operation, or operates as an evaporator during the heating operation. The outdoor fan 9 is a device that sends outdoor air to the outdoor heat exchanger 8.

The expansion unit 10 is a pressure reducing valve or an expansion valve that reduces the pressure of refrigerant and expands the refrigerant. The expansion unit 10 is, for example, an electronic expansion valve whose opening degree is adjusted. The heat exchanger 11 causes heat exchange to be performed, for example, between indoor air and refrigerant. The heat exchanger 11 operates as an evaporator during the cooling operation, or operates as a condenser during the heating operation. The indoor fan 12 is a device that sends indoor air to the heat exchanger 11.

It should be noted that refrigerant that is filled into the refrigerant circuit 4 is, for example, a hydrocarbon-based flammable refrigerant such as R290. As indicated in Table 1, R290 is lower-pressure refrigerant that has a lower saturation pressure than that of R32 that is an HFC refrigerant currently widely used as refrigerant for the air-conditioning apparatus 1. Since the R290 refrigerant has a lower density than the R32 refrigerant, the R290 refrigerant flows at a higher speed in an evaporator in which the refrigerant is in a low-temperature and low-pressure two-phase gas-liquid state, and the pressure loss of the refrigerant is thus great.

TABLE 1

| REFRIGERANT | | R32 | R290 |
|---|---|---|---|
| SATURATION PRESSURE (10° C.) | Mpa | 1.11 | 0.64 |
| GAS DENSITY (10° C.) | $Kg/m^3$ | 30.2 | 13.8 |

(Heat Exchanger 11)

Figure 2:
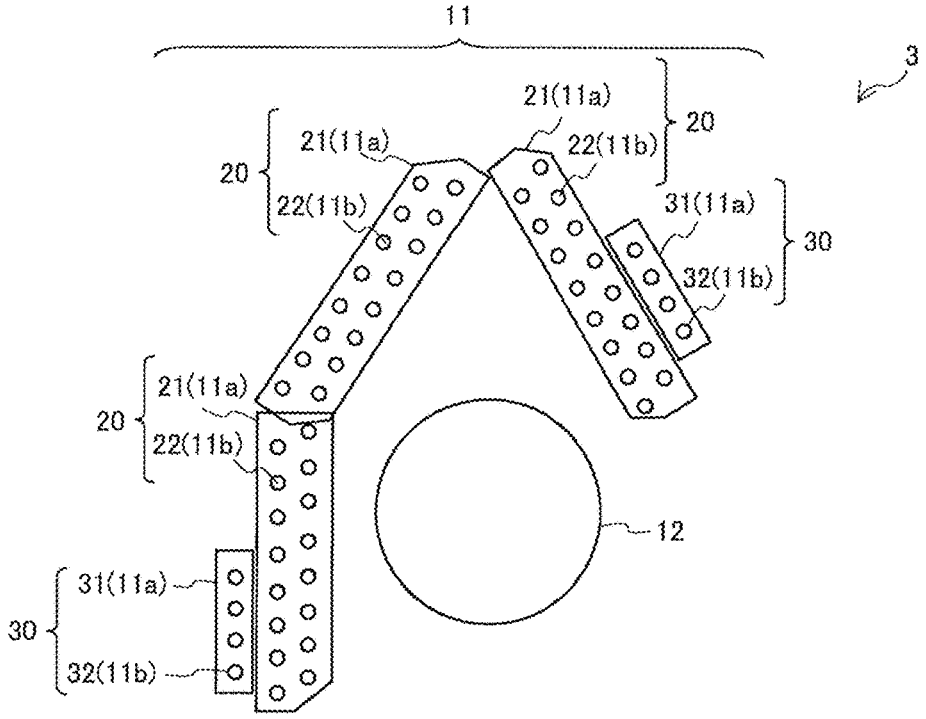
FIG. 2 is a side view illustrating an indoor unit according to Embodiment 1.

FIG. 2 is a side view illustrating the indoor unit 3 according to Embodiment 1. As illustrated in FIG. 2, in the indoor unit 3, the heat exchanger 11 is provided in such a manner as to surround the indoor fan 12. The heat exchanger 11 provided in the indoor unit 3 is a fin-and-tube heat exchanger, and includes a plurality of fins 11*a* and a plurality of tubes 11*b*.

The heat exchanger 11 includes main heat-exchange portions 20 and sub-heating exchange portions 30. When the heat exchanger 11 operates as a condenser during the heating operation, in the main heat-exchange portions 20, refrigerant is in a gas-phase state or in a two-phase gas-liquid state, and in the sub-heat-exchange portions 30, refrigerant is in a subcooled state.

(Fin 11*a*)

The plurality of fins 11*a* are arranged and spaced from each other in a single direction that is a width direction of the heat exchanger 11. Indoor air sucked into the indoor unit 3 passes through the space between the fins 11*a*. The fins 11*a* include first fins 21 that are included in the main heat-exchange portions 20, and second fins 31 that are included in the sub-heat-exchange portions 30.

(Tube 11*b*)

The tubes 11*b* are, for example, members that are made of metal and extend in a longitudinal direction in which the tubes 11*b* are inserted perpendicular to the plurality of fins 11*a*. Refrigerant flows in the tubes 11*b*. The tubes 11*b* are partially exposed from the space between the fins 11*a*. Thus, indoor air that passes through the space between the fins 11*a* hits the tubes 11*b*, and heat exchange is performed between the indoor air and refrigerant that flows in the tubes 11*b*. Indoor air sucked into the indoor unit 3 by a fan passes through the space between the fins 11*a* of the heat exchanger 11 whereby the indoor air is heated during the heating operation, or is cooled during the cooling operation. The tubes 11*b* include first heat transfer tubes 22 that are included in the main heat-exchange portions 20, and second heat transfer tubes 32 that are included in the sub-heat-exchange portions 30.

(First Heat Transfer Tube 22)

Figure 3:
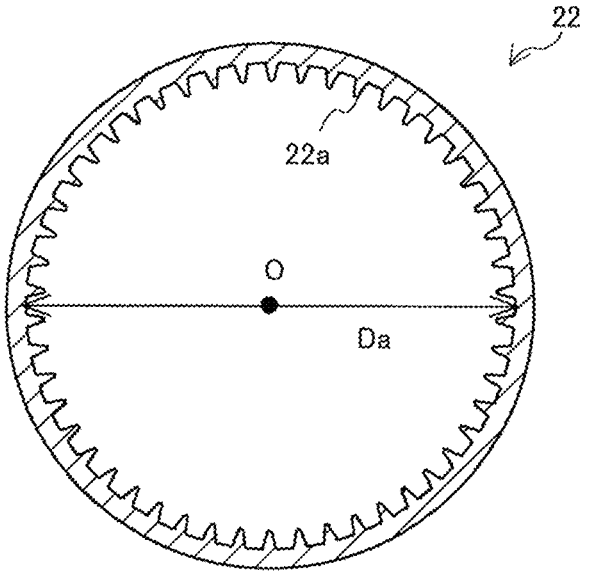
FIG. 3 is a side cross-sectional view illustrating a first heat transfer tube according to Embodiment 1.

FIG. 3 is a side cross-sectional view illustrating each of the first heat transfer tubes 22 according to Embodiment 1. As illustrated in FIG. 3, the first heat transfer tube 22 is a grooved tube having a plurality of helical grooves 22*a* formed in the inner surface of the first heat transfer tube 22 in the longitudinal direction thereof. The first heat transfer tube 22 has a circular cross-sectional shape. The first heat transfer tube 22 has an inside diameter Da that corresponds to the length of a straight line that extends from a bottom surface of a groove 22*a* to a bottom surface of another groove 22*a* through a center ○ of the first heat transfer tube 22. It is assumed that the inside diameter Da is the maximum inside diameter, and the length of a straight line that extends from an upper end of one groove 22*a* to an upper end of another groove 22*a* through the center ○ of the first heat transfer tube 22 is equivalent to the minimum inside diameter.

Figure 4:
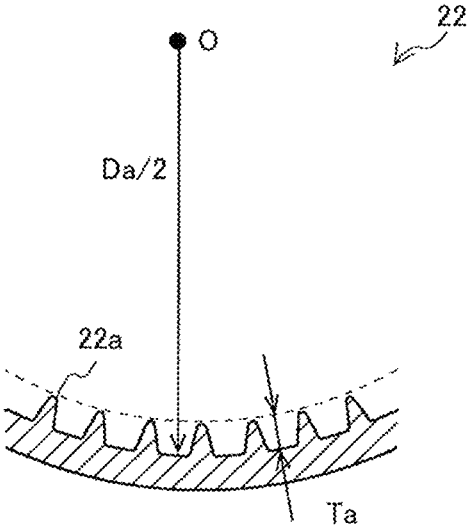
FIG. 4 is an enlarged view of the side cross-sectional view illustrating the first heat transfer tube according to Embodiment 1.

FIG. 4 is an enlarged view of the side cross-sectional view illustrating each of the first heat transfer tubes 22 according to Embodiment 1. As illustrated in FIG. 4, the depth Ta of each of the grooves 22*a* formed in the inner portion of the first heat transfer tube 22 corresponds to the distance from the bottom surface of the groove 22*a* to the upper end of the groove 22*a*.

(Second Heat Transfer Tube 32)

Figure 5:
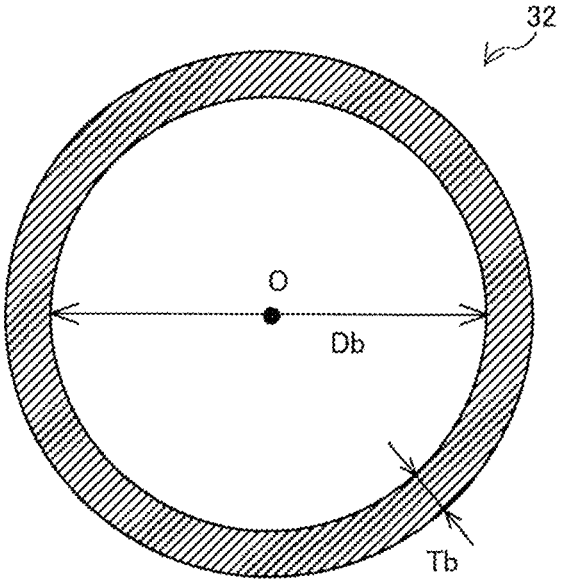
FIG. 5 is a side cross-sectional view illustrating a second heat transfer tube according to Embodiment 1.

FIG. 5 is a side cross-sectional view illustrating each of the second heat transfer tubes 32 according to Embodiment 1. As illustrated in FIG. 5, the second heat transfer tube 32 is a smooth tube having a smoothed inner surface, and has a circular cross-sectional shape. The second heat transfer tube 32 has an inside diameter Db equivalent to the length of a straight line that extends from part of the inner surface (inner wall) to another part of the inner surface through a center ○ of the second heat transfer tube 32. It should be noted that the second heat transfer tube 32 has a thickness Tb and has an outside diameter that is Db+Tb.

A flow passage for refrigerant that flows in the heat exchanger 11 includes a plurality of flow passages that connect the first heat transfer tubes 22 in the main heat-exchange portions 20 and the second heat transfer tubes 32 in the sub-heat-exchange portions 30, and a flow passage that is formed such that the plurality of flow passages join each other.

Figure 6:
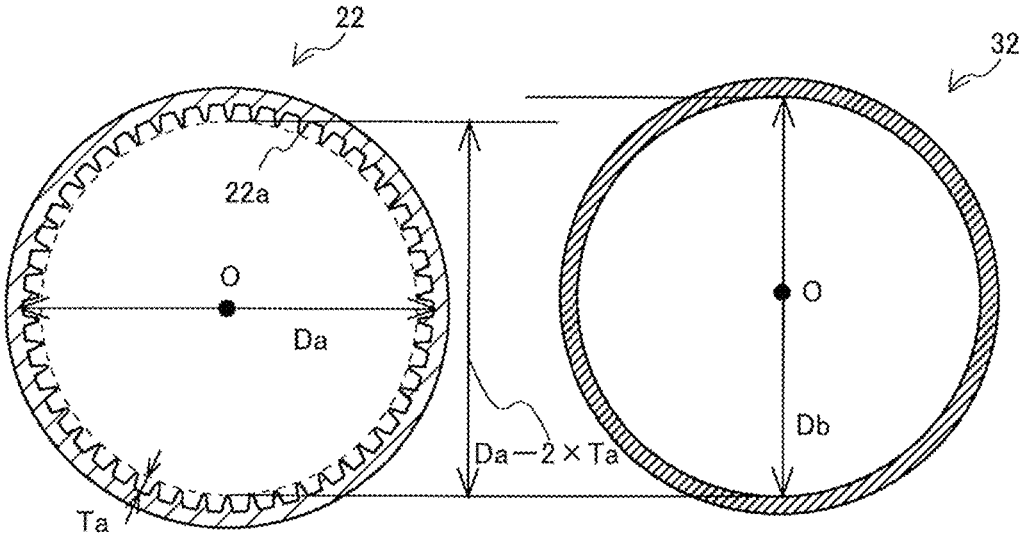
FIG. 6 is a side cross-sectional view illustrating a relationship in dimension between the first heat transfer tube and the second heat transfer tube according to Embodiment 1.

FIG. 6 is a side cross-sectional view illustrating a relationship in dimension between the first heat transfer tube 22 and the second heat transfer tube 32 according to Embodiment 1. As illustrated in FIG. 6, the relationship in dimension between the first heat transfer tube 22 and the second heat transfer tube 32 satisfies $Da-2\times Ta\leq Db$. That is, the value obtained by subtracting the depth Ta of two grooves 22*a* from the inside diameter Da of the first heat transfer tube 22 is smaller than or equal to the inside diameter Db of the second heat transfer tube 32.

As the second heat transfer tube 32, an appropriate heat transfer tube is selected from among heat transfer tubes that are distributed in large quantity in the market and offer high versatility. For example, as the second heat transfer tube 32, from among heat transfer tubes having respective outside diameters and respective thicknesses, a heat transfer tube having the following inside diameter Db is selected. The inside diameter Db is larger than or equal to and is the closest to the value obtained by subtracting the depth Ta of two grooves 22*a* from the inside diameter Da of the first heat transfer tube 22. In such a manner, since the second heat transfer tube 32 is selected from among heat transfer tubes distributed in large quantity in the market and offering high versatility, it is possible to obtain heat transfers tubes more easily and at a lower cost than custom-ordered heat transfer tubes having optimal dimensions. In the case where the first heat transfer tube 22 has an outside diameter of φ7, and the case where the first heat transfer tube 22 has an outside diameter of φ5, a heat transfer tube to be selected as the second heat transfer tube 32 has an outside diameter as indicated in Table 2.

TABLE 2

| OUTSIDE DIAMETER OF FIRST HEAT TRANSFER TUBE | Da | Ta | Da − 2 × Ta | OUTSIDE DIAMETER OF HEAT TRANSFER TUBE TO BE SELECTED |
|---|---|---|---|---|
| φ7 | Φ6.54 | 0.15 mm | 6.24 mm | Φ6.35 |
| Φ5 | Φ4.58 | 0.15 mm | 4.28 mm | Φ4.76 |

As illustrated in Table 2, in the case where the first heat transfer tube 22 has an outside diameter of φ7, the groove 22*a* has a depth Ta of 0.15 mm, and the first heat transfer tube 22 has an inside diameter Da of φ6.54. In this case, $Da-2\times Ta$ is 6.24 mm. Thus, in the case where $Da-2\times Ta\leq Db$ is taken into account, a heat transfer tube having an outside diameter of φ6.35 is selected as the second heat transfer tube 32. In addition, in the case where the first heat transfer tube 22 has an outside diameter of φ5, the groove 22*a* has a depth Ta of 0.15 mm, and the first heat transfer tube 22 has an inside diameter Da of φ4.58. In this case, $Da-2\times Ta$ is 4.28 mm. Thus, in the case where $Da-2\times Ta\leq Db$ is taken into account, the heat transfer tube having an outside diameter of φ4.76 is selected as the second heat transfer tube 32.

It should be noted that the number of the main heat-exchange portions 20 and the number of the sub-heat-exchange portions 30 are appropriately determined depending on the heat exchange capacity, air velocity distribution, and other factors of the air-conditioning apparatus 1. In addition, the number of the first heat transfer tubes 22 in the main heat-exchange portions 20 and the number of the second heat transfer tubes 32 in the sub-heat-exchange portions 30 are appropriately determined depending on the heat exchange capacity, air velocity distribution, and other factors of the air-conditioning apparatus 1.

(Operation Mode: Cooling Operation)

Next, operating modes of the air-conditioning apparatus 1 will be described. First, the cooling operation will be described. During the cooling operation, refrigerant sucked into the compressor 6 is compressed by the compressor 6 into high-temperature and high-pressure gas refrigerant, and the high-temperature and high-pressure gas refrigerant is discharged. The high-temperature and high-pressure gas refrigerant discharged from the compressor 6 passes through the flow switching device 7 and flows into the outdoor heat exchanger 8 that operates as a condenser. In the outdoor heat exchanger 8, the refrigerant exchanges heat with outdoor air sent by the outdoor fan 9, and condenses to change into liquid refrigerant. The liquid refrigerant obtained through the above condensation flows into the expansion unit 10, and is expanded and reduced in pressure in the expansion unit 10 to change into low-temperature and low-pressure two-phase gas-liquid refrigerant. The two-phase gas-liquid refrigerant flows into the heat exchanger 11 that operates as an evaporator. In the heat exchanger 11, the refrigerant exchanges heat with indoor air sent by the indoor fan 12, and evaporates to change into low-temperature and low-pressure gas refrigerant. At this time, the indoor air is cooled and cooling is thus performed in the room. The low-temperature and low-pressure gas refrigerant obtained through the above evaporation passes through the flow switching device 7 and is sucked into the compressor 6.

(Operation Mode: Heating Operation)

Next, the heating operation will be described. During the heating operation, refrigerant sucked into the compressor 6 is compressed by the compressor 6 into a high-temperature and high-pressure gas refrigerant, and the high-temperature and high-pressure gas refrigerant is then discharged. The high-temperature and high-pressure gas refrigerant discharged from the compressor 6 passes through the flow switching device 7 and flows into the heat exchanger 11 that operates as a condenser. In the heat exchanger 11, the refrigerant exchanges heat with indoor air sent by the indoor fan 12, and condenses to change into liquid refrigerant. At this time, the indoor air is heated and heating is thus performed in the room. The liquid refrigerant obtained through the above condensation flows into the expansion unit 10, and is expanded and reduced in pressure in the expansion unit 10 to change into low-temperature and low-pressure two-phase gas-liquid refrigerant. The two-phase gas-liquid refrigerant flows into the outdoor heat exchanger 8 that operates as an evaporator. In the outdoor heat exchanger 8, the refrigerant exchanges heat with outdoor air sent by the outdoor fan 9, and evaporates to change into low-temperature and low-pressure gas refrigerant. The low-temperature and low-pressure gas refrigerant obtained through the above evaporation passes through the flow switching device 7 and is sucked into the compressor 6.

Next, the flow of refrigerant in the heat exchanger 11 will be described. First of all, the cooling operation will be referred to. During the cooling operation, refrigerant that is expanded by the expansion unit 10 and then flows into the heat exchanger 11 has a low temperature, a low pressure, and a low quality. Two-phase gas-liquid refrigerant containing a larger amount of liquid-phase refrigerant first flows into the sub-heat-exchange portions 30 in the heat exchanger 11. The refrigerant exchanges heat with ambient air, is heated to change because of latent heat and flows through the main heat-exchange portions 20. The refrigerant that flows through the main heat-exchange portions 20 is changed into two-phase gas-liquid refrigerant having a high quality. The two-phase gas-liquid refrigerant exchanges heat with ambient air and is further heated to change into superheated steam, and the superheated steam is sucked into the compressor 6.

Next, the heating operation will be referred to. During the heating operation, refrigerant that is discharged from the compressor 6 and then flows into the heat exchanger 11 is in a high-temperature and high-pressure superheated steam state. The refrigerant being in the superheated steam state first flows into the main heat-exchange portions 20 in the heat exchanger 11. The refrigerant then exchanges heat with ambient air, is cooled to a condensing temperature to change because of latent heat, and flows through the sub-heat-exchange portions 30. The refrigerant that flows through the sub-heat-exchange portions 30 exchanges heat with ambient air, and is further cooled to be in a saturated liquid state, whereby a sensible-heat change occurs, the refrigerant changes into subcooled refrigerant, and the subcooled refrigerant flows into the expansion unit 10.

According to Embodiment 1, since $Da-2\times Ta\leq Db$ is satisfied, the inside diameter Db of the second heat transfer tube 32 is set to the greatest possible value. It is therefore possible to reduce lowering of the pressure loss of refrigerant that flows through the second heat transfer tube 32. Therefore, the heat exchanger 11 can reduce lowering of the heat exchange efficiency.

As described above, the heat exchanger 11 includes the main heat-exchange portions 20 and the sub-heat-exchange portions 30. Each of the first heat transfer tubes 22 in the main heat-exchange portions 20 is a grooved tube. Each of the second heat transfer tubes 32 in the sub-heat-exchange portions 30 is a smooth tube. As the second heat transfer tube 32, from among heat transfer tubes having respective outside diameters and thicknesses, a heat transfer tube having the following inside diameter Db is selected. The inside diameter Db is larger than or equal to and is the closest to the value obtained by subtracting the depth Ta of two grooves 22*a* from the inside diameter Da of the first heat transfer tube 22. It should be noted that since each of the first heat transfer tubes 22 in the main heat-exchange portions 20 is a grooved tube, the heat transfer area of the inside of the tube is increased. When the heat exchanger 11 operates as a condenser, and also operates as an evaporator, two-phase gas-liquid refrigerant that flows in the first heat transfer tubes 22 becomes a swirling flow in the tubes and is stirred. Therefore, the heat transfer performance of the first heat transfer tubes 22 can be improved.

When a heat exchanger operates as a condenser during the heating operation, refrigerant that flows through sub-heat-exchange portions is in a subcooled state. Heat exchange does not easily occur in the sub-heat-exchange portions, as compared with main heat-exchange portions in which refrigerant is in a two-phase gas-liquid state. In view of this point, it is conceivable that the tube diameter of a second heat transfer tube is simply reduced to increase the flow rate of refrigerant that flows in the second transfer tube and thus improve the heat exchange performance. However, when the heat exchanger operates as an evaporator during the cooling operation, refrigerant that flows through the sub-heat-exchange portions is two-phase gas-liquid refrigerant containing a larger amount of low-temperature and low-pressure liquid-phase refrigerant. Therefore, as the tube diameter is reduced, the pressure loss is increased, and the heat exchange efficiency of the air-conditioning apparatus is reduced. Accordingly, the pressure of refrigerant to be sucked into a compressor is reduced. As the suction pressure is reduced, the power consumption in the compressor is increased, and the operating efficiency of the air-conditioning apparatus is reduced.

By contrast, in Embodiment 1, as the second heat transfer tube 32, from among heat transfer tubes having respective outside diameters and respective thicknesses, a heat transfer tube having the following inside diameter Db is selected. The inside diameter Db is larger than or equal to and is the closest to the value obtained by subtracting the depth Ta of two grooves 22*a* from the inside diameter Da of the first heat transfer tube 22. It is therefore possible to prevent the second heat transfer tube 32 from having an excessively larger tube diameter, and thus reduce lowering of the pressure loss that is caused by reduction of the tube diameter.

Embodiment 2

Figure 7:
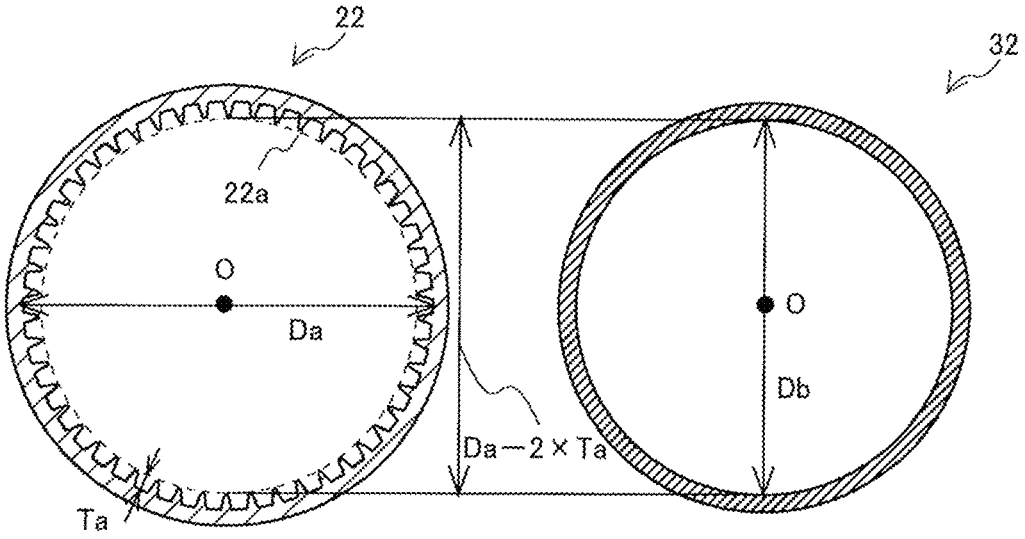
FIG. 7 is a side cross-sectional view illustrating a relationship in dimension between a first heat transfer tube and a second heat transfer tube according to Embodiment 2.

FIG. 7 is a side cross-sectional view illustrating a relationship in dimension between the first heat transfer tube 22 and a second heat transfer tube 132 according to Embodiment 2. In Embodiment 2, the relationship in dimension between the first heat transfer tube 22 and the second heat transfer tube 132 satisfies $Da-2\times Ta=Db$. In this regard, Embodiment 2 is different from Embodiment 1. Regarding Embodiment 2, components that are the same as those in Embodiment 1 will be denoted by the same reference signs, and their descriptions will thus be omitted. Embodiment 2 will be described mainly by referring to the differences between Embodiments 1 and 2.

As illustrated in FIG. 7, the relationship in dimension between the first heat transfer tube 22 and the second heat transfer tube 132 satisfies $Da-2\times Ta=Db$. That is, the value obtained by subtracting the depth Ta of two grooves 22*a* from the inside diameter Da of the first heat transfer tube 22 is equal to the inside diameter Db of the second heat transfer tube 132. Therefore, the inside diameter Db of the second heat transfer tube 132 is smaller than the inside diameter Da of the first heat transfer tube 22.

When the heat exchanger 11 operates as an evaporator during the cooling operation, refrigerant that flows through the second heat transfer tubes 132 in the sub-heat-exchange portions 30 is two-phase gas-liquid refrigerant that contains a large amount of low-temperature and low-pressure liquid-phase refrigerant. Thus, the refrigerant flows at a lower speed than refrigerant that flows through the first heat transfer tubes 22 in the main heat-exchange portions 20. In Embodiment 2, since the inside diameter Db of the second heat transfer tube 132 is smaller than the inside diameter Da of the first heat transfer tube 22, the flow speed of refrigerant that flows in the second heat transfer tubes 132 is increased. Therefore, the heat transfer performance of the second heat transfer tubes 132 can be improved.

In the case where refrigerant has a relatively low quality, and a heat transfer tube has a relatively small tube diameter, and then even in the case where the grooves 22*a* are formed in the inner surface of the heat transfer tube, the heat transfer performance of the heat transfer tube cannot be expected to be improved. In Embodiment 2, the inside diameter Db of the second heat transfer tube 132 that is a smooth tube is smaller than the inside diameter Da of the first heat transfer tube 22 that is a grooved tube. Thus, although the grooves 22*a* are not formed in the second heat transfer tube 132, refrigerant that flows along the center ○ of the second heat transfer tube 132 easily exchanges heat with the inner surface, since the distance between the inner surface and the center ○ is smaller. Therefore, the heat transfer performance of the second heat transfer tubes 132 can be improved.

When the heat exchanger 11 operates as a condenser during that heating operation, refrigerant that flows through the sub-heat-exchange portions 30 is subcooled refrigerant. When the heat exchanger 11 operates as an evaporator during the cooling operation, refrigerant flowing through the sub-heat-exchange portions 30 is two-phase gas-liquid refrigerant containing a larger amount of liquid-phase refrigerant. In Embodiment 2, the inside diameter Db of the second heat transfer tube 132 that is a smooth tube is smaller than the inside diameter Da of the first heat transfer tube 22 that is a grooved tube. Therefore, the inner volume of the second heat transfer tube 132 is reduced, and the amount of refrigerant to be filled in the refrigerant circuit 4 can thus be reduced.

The flow direction of refrigerant that circulates through the pipes is changed in a switching manner to perform the heating operation or the cooling operation. In recent years, in the air-conditioning apparatus 1, hydrofluorocarbon (HFC) refrigerant has been widely used as refrigerant that circulates in the refrigerant circuit 4. However, the global warming potential of the HFC refrigerant is considerably high and several hundred to several thousand times higher than that of carbon dioxide. Thus, there is apprehension that use of the HFC refrigerant may cause global warming. Therefore, as refrigerant for use in the air-conditioning apparatus 1, it is required to use a hydrocarbon-based natural refrigerant such as an R290 refrigerant that has a lower global warming potential. Also, it is required to reduce the amount of refrigerant to be filled. Since hydrocarbon-based refrigerants such as an R290 refrigerant are flammable, it is required to reduce the amount of refrigerant to be filled in order that safety be ensured even when the refrigerant leaks into a closed space. In Embodiment 2, the amount of refrigerant to be filled in the refrigerant circuit 4 can be reduced as described above. Therefore, in Embodiment 2, it is possible to obtain a further remarkable advantage in the case where the R290 refrigerant is used.

In Embodiment 2, as the second heat transfer tube 132, from among heat transfer tubes having respective thicknesses and respective outside diameters, a heat transfer tube having the following inside diameter Db is selected. The inside diameter Db is obtained by subtracting the depth Ta of two grooves 22*a* from the inside diameter Da of the first heat transfer tube 22. The second heat transfer tube 132 used in the embodiment does not have an excessively large tube diameter. Thus, it is possible to reduce an increase in pressure loss that is caused by reduction of the tube diameter. Furthermore, the inside diameter Db of the second heat transfer tube 132 that is a smooth tube is smaller than the inside diameter Da of the first heat transfer tube 22 that is a grooved tube. Therefore, in Embodiment 2, it is possible to improve the heat transfer performance and reduce the amount of refrigerant because of reduction of the tube diameter, while reducing an increase in pressure loss.

It should be noted that regarding Embodiments 1 and 2, although it is described by way of example that the heat exchanger 11 is provided in the indoor unit 3, the heat exchanger 11 may be replaced by the outdoor heat exchanger 8. In the case where the outdoor heat exchanger 8 operates as a condenser during the cooling operation, the outdoor heat exchanger 8 is divided into a condensing region and a subcooling region. A flow passage for refrigerant that flows in the outdoor heat exchanger 8 includes a plurality of flow passages and a flow passage formed by joining the plurality of flow passages. In the condensing region, the first heat transfer tubes 22 are provided, and in the subcooling region, the second heat transfer tubes 32 are provided. The second heat transfer tube 32 provided in the subcooling region is selected from among heat transfer tubes that are distributed in large quantity in the market and offer high versatility.

For example, as the second heat transfer tube 32, from among heat transfer tubes having respective thicknesses and respective outside diameters, a heat transfer tube having the following inside diameter Db is selected. The inside diameter Db is larger than or equal to and is the closest to the value that is obtained by subtracting the depth Ta of two grooves 22*a* from the inside diameter Da of the first heat transfer tube 22. The second heat transfer tube 32 is selected from among heat transfer tubes that are distributed in large quantity in the market and offer high versatility, whereby it is possible to obtain heat transfers tubes more easily and at a lower cost than custom-ordered heat transfer tubes having optimal dimensions. As described above, even when the heat exchanger 11 is replaced with the outdoor heat exchanger 8, the air-conditioning apparatus 1 still obtains the same advantages as in the case where the heat exchanger 11 is provided in the indoor unit 3.

REFERENCE SIGNS LIST

1: air-conditioning apparatus, 2: outdoor unit, 3: indoor unit, 4: refrigerant circuit, 5: refrigerant pipe, 6: compressor, 7: flow switching device, 8: outdoor heat exchanger, 9: outdoor fan, 10: expansion unit, 11: heat exchanger, 11*a*: fin, 11*b*: tube, 12: indoor fan, 20: main heat-exchange portion, 21: first fin, 22: first heat transfer tube, 22*a*: groove, 30: sub-heat-exchange portion, 31: second fin, 32: second heat transfer tube, 132: second heat transfer tube.

The invention claimed is:

1. An air-conditioning apparatus comprising a heat exchanger, the heat exchanger comprising:

a compressor configured to compress refrigerant;

a condenser configured to cause heat exchange to be performed between air and the refrigerant compressed by the compressor;

an expansion unit configured to expand the refrigerant subjected to the heat exchange at the condenser; and an evaporator configured to cause heat exchange to be performed between air and the refrigerant expanded by the expansion unit;

wherein the condenser or the evaporator includes a plurality of fins; and a plurality of tubes inserted into the fins and configured to allow the refrigerant to flow in the tubes, wherein the tubes include first heat transfer tubes, each first heat transfer tube including grooves formed in an inner surface of the first heat transfer tube and having an inside diameter Da and a groove depth Ta, and second heat transfer tubes, each second heat transfer tube having a smoothed inner surface, having an inside diameter Db, and being connected to an associated one of the first heat transfer tubes, wherein $Da-2\times Ta=Db$ is satisfied, and wherein when the heat exchanger is the condenser, the refrigerant that flows in each of the first heat transfer tubes is in a gas-phase state or in a two-phase gas-liquid state, and the refrigerant that flows in each of the second heat transfer tubes is in a subcooled state.

2. The air-conditioning apparatus of claim 1, wherein the refrigerant is an R290 refrigerant.

* * * * *